US012735909B2

(12) United States Patent
Barton

(10) Patent No.: US 12,735,909 B2
(45) Date of Patent: Sep. 15, 2026

(54) CONSTRUCTION MATERIAL REPAIR DEVICE AND METHODS OF USING SAME

(71) Applicant: Scott Barton, Clifton Park, NY (US)

(72) Inventor: Scott Barton, Clifton Park, NY (US)

( * ) Notice: Subject to any disclaimer, the term of this patent is extended or adjusted under 35 U.S.C. 154(b) by 234 days.

(21) Appl. No.: 18/824,075

(22) Filed: Sep. 4, 2024

(65) Prior Publication Data

US 2026/0062937 A1 Mar. 5, 2026

(51) Int. Cl.
*E04G 23/02* (2006.01)

(52) U.S. Cl.
CPC ..... *E04G 23/0207* (2013.01); *E04G 23/0203* (2013.01)

(58) Field of Classification Search
CPC . E04G 23/02; E04G 23/0211; E04G 23/0207; F16B 39/36; F16B 39/124; F16B 21/205
USPC ..... 411/265; 52/514
See application file for complete search history.

(56) References Cited

U.S. PATENT DOCUMENTS 2,476,601 A * 7/1949 Harper ..... B63B 43/16 114/227
4,067,759 A * 1/1978 Vrolyk ..... B29C 73/00 427/140
5,145,301 A * 9/1992 Yamamoto ..... F16B 13/141 411/72
5,219,452 A * 6/1993 Yamamoto ..... F16B 13/141 411/930
5,499,737 A * 3/1996 Kraus ..... F16B 37/043 138/89
6,189,573 B1 * 2/2001 Ziehm ..... F16L 55/1141 138/104
6,360,779 B1 * 3/2002 Wagner ..... F16L 55/1141 220/802
7,905,068 B2 * 3/2011 Waters, Jr. ..... E04C 5/18 52/576
8,689,717 B2 * 4/2014 Benveniste ..... B63B 43/16 114/227
8,696,285 B2 * 4/2014 Bertels ..... F16B 33/02 411/366.1
8,707,525 B2 * 4/2014 Davies ..... F16B 5/0628 24/297
11,619,252 B2 * 4/2023 Faghidi ..... F16B 13/002 411/29
2005/0000973 A1 * 1/2005 Sbongk ..... F16J 13/14 220/802
2015/0247519 A1 * 9/2015 Call ..... F16B 25/0078 411/403
2016/0102696 A1 * 4/2016 DeClark ..... F16B 13/128 411/60.2
2016/0102698 A1 * 4/2016 Glass ..... F16B 13/002 411/393
2020/0071946 A1 * 3/2020 Johnson ..... E04G 23/0203
2023/0204061 A1 * 6/2023 Stathis ..... F16B 13/128 411/42

(Continued)

*Primary Examiner* — Paola Agudelo
(74) *Attorney, Agent, or Firm* — Kevin Houser

(57) ABSTRACT

A construction material repair device designed for filling, repairing, and restoring defects in construction materials comprising right-handed female tapered helical thread to aid insertion and adhesively secured into the construction material to cosmetically repair and structurally restore the defect in minimal steps, time, and cost. The device is manufactured in a variety of materials to match or complement the construction material requiring repair.

20 Claims, 18 Drawing Sheets

(56) References Cited

U.S. PATENT DOCUMENTS

2023/0265877 A1* 8/2023 Keller ..... F16B 25/0068
411/387.4

* cited by examiner

SECTION B-B

CONSTRUCTION MATERIAL REPAIR DEVICE AND METHODS OF USING SAME

FIELD OF THE INVENTION

The present invention relates to devices and methods for the repair of construction materials and more specifically to devices and methods for use in filling, repairing and restoring defects in construction materials made during manufacturing, construction or renovation.

BACKGROUND

Filling, repairing, and restoring through-holes, cracks, dents, and other localized defects during the manufacture, installation, or renovation of industrial, commercial, and residential construction materials is problematic. Preparing, sizing, fitting, cutting, sanding, finishing and restoring damaged construction materials cosmetically and structurally requires knowledge, experience, and skilled individuals additional time and cost and can still leave visible defects if not done correctly.

Existing repair products such as adhesive, tape, patches, and screens only provide cosmetic repair and do not structurally restore the construction material. As such, the repaired construction material continues to have a structural defect which prevents it from servicing its full structural use. These products often also require the expansion of an existing defect in the construction material in order to provide their limited cosmetic use, potentially further compromising the structural qualities of the construction material. For instance, a defect in a drywall sheet made during the removal or relocation of an electrical switch often requires the person performing the task to cut out a larger area than the original switch box occupied in order to install a patch over the defect. In many cases these holes do not back up against wall studs and so the patch is left to obtain its structural integrity from the pre-existing drywall around the patch area, a condition that leads to poor structural stability of the patch.

Patches of these types also require some level of construction skill to obtain acceptable structural and cosmetic results. The removal of the right amount of the original defect area to accommodate the patch as well as the ability to properly size the patch to fit the defect and attach it to the remaining construction material presents challenges for those not skilled in construction repair.

In addition, adhesive, tape, patches, and screens often shrink over time and need to be reapplied repetitively. This requires costly repairs to the construction materials and additional time at a later date to address these issues. They also do not closely approximate the thermal expansion coefficients of the materials under repair and therefore may create discontinuities under thermal cycling.

Therefore, there exists a long-felt need in the construction industry for an improvement in the devices and methods used to repair defects in construction materials such that the repaired areas continue to have good structural characteristics as well as cosmetic characteristics and which are easily and correctly installed by either a skilled tradesperson or a person of only rudimentary construction skills. There is also a long-felt need for repair materials that more closely approximate the characteristics of the materials under repair.

SUMMARY

In a first embodiment of the construction material repair device, the construction material repair device comprises a conical portion including a conical surface area, forming a right circular cone, a recess which includes a recess area and which forms a helical cut in the conical surface, the recess area defined as the area of the conical surface area removed by the recess, a distal end whereby the distal end is located at the apex of the conical surface and includes a distal end feature, a proximal end opposite the distal and including a planar proximal surface perpendicular to the axis of the conical surface, a recess edge formed by the intersection of the recess and the conical surface and a tab located on the planar proximal surface, whereby the tab extends perpendicularly from the planar proximal surface and whereby the recess area is less than the area of the conical surface area outside of the recess.

In a first aspect of the first embodiment of the construction material repair device, the distal end feature of the primary embodiment comprises either a flat planar face parallel to the planar proximal surface of the primary embodiment or a spherical radius where the point at which the radius intersects the conical surface is the tangent point of the spherical radius with the conical surface.

In a second aspect of any of the embodiments of the construction material repair device described above, the useful length of the device is defined as the distance between the proximal planar proximal surface and the distal most end of the construction material repair device and where the useful length is greater than the length of the defect in the construction material being repaired. Additional useful length is defined as the distance between the planar proximal surface and the proximal end of the tab.

In a third aspect of any of the embodiments of the construction material repair device described above, the device is formed from a material selected from one of a chalk, a wood, a fiberglass material, a drywall compound or a plastic.

In a fourth aspect of any of the embodiments of the construction material repair device described above, the construction material repair device is disposed to accept a construction adhesive on said conical portion, said proximal planar surface and said tab.

In a fifth aspect of any of the embodiments of the construction material repair device described above, the construction adhesive is selected from one of a drywall compound, a structural polyurethane adhesive, an epoxy adhesive, a glue, or a silicone adhesive.

In a sixth aspect of any of the embodiments of the construction material repair device described above, the cross-sectional area of said recess is disposed to allow a flow of said construction adhesive within said recess.

In a seventh aspect of any of the embodiments of the construction material repair device described above, the recess edge is radiused.

In an eighth aspect of any of the embodiments of the construction material repair device described above, the tab further comprises a tab recess.

In a ninth aspect of any of the embodiments of the construction material repair device described above, the construction adhesive is placed on the conical portion, base and tab of the construction material repair device and the construction material repair device is placed in the hole of the construction material and the construction material repair device is advanced into the hole until the conical portion forms an interference fit with the construction material.

In a tenth aspect of any of the embodiments of the construction material repair device described above the construction material repair device further comprises at least three zones, whereby a first zone of the at least three zones is the portion of the construction material repair device proximal to the proximal side of the construction material.

In an eleventh aspect of any of the embodiments of the construction material repair device described above a second zone of the at least three zones is the portion of the construction material repair device that is distal to a distal side of the construction material, whereby the distal side is the side of the construction material opposite said proximal side.

In a twelfth aspect of any of the embodiments of the construction material repair device described above a third zone of the at least three zones is the portion of the construction material repair device that is between zone one and zone two.

In a thirteenth aspect of any of the embodiments of the construction material repair device described above whereby the placement of the construction material repair device in the hole in the construction material being repaired causes the construction adhesive on the distal side and the proximal side of the construction material to extend beyond the hole in the construction material and onto the proximal and distal sides of the construction material.

In a second embodiment of the construction material repair device, the construction material repair device comprises a conical portion including a conical surface area, forming a right circular cone, a recess which includes at least one recess area defined as the area of the conical surface removed by the recess, a proximal end, a distal end whereby the distal end is located at the apex of the conical surface, a recess edge formed by the intersection of the conical surface and the at least one recess and a proximal planar surface at the proximal end of the construction material repair device, an end feature at the distal end of the construction material repair device and a tab located on the planar proximal surface, whereby the tab extends perpendicularly from the planar proximal surface and whereby the tab further comprises an opening in the tab, whereby recess area is less than the area of the conical surface area outside of the recess and whereby the recess forms one of a right handed tapered helical cut, a left handed tapered helical cut or a combination of right handed and left handed tapered helical cuts.

In a first aspect of the second embodiment described above, the opening in the tab comprises one of a hole, a blind hole, a plurality of holes, a plurality of blind holes an elongated slot, a blind elongated slot, a plurality of elongated slots, a plurality of blind elongated slots or a combination of holes and slots.

In a second aspect of the second embodiment described above, the construction material repair device is formed from a material selected from one of a chalk, a wood, a fiberglass material, a drywall compound or a plastic.

In a third aspect of the second embodiment described above, the construction material repair device is disposed to accept a construction adhesive on the conical portion, the proximal planar surface and the tab.

In a fourth aspect of the second embodiment described above, a cross-sectional area of the at least one recess is disposed to allow the flow of a construction adhesive within the at least one recess and whereby the construction adhesive is selected from one of a drywall compound, a structural polyurethane adhesive, an epoxy adhesive, a glue or a silicone adhesive.

In a third embodiment of the construction material repair device, similar to the first embodiment, the conical portion of the device is disposed at less than a thirty degree angle off of the central axis of the device.

In a fourth embodiment of the construction material repair device, similar to the first embodiment, the construction material repair device includes a distal end planar surface and a proximal end planar surface and the recess extends into the proximal planar surface and the distal planar surface.

In a fifth embodiment of the construction material repair device, similar to the first embodiment, the construction material repair device further comprises a channel internal to the conical portion of the construction material repair device, a hole in the proximal planar surface in communication with the channel and at least one hole in the recess in communication with the channel and the hole in the proximal planar surface.

In a sixth embodiment of the construction material repair device, the conical portion comprises an inner conical portion and an outer conical portion, the inner and outer conical portions disposed to allow relative movement to each other along the central axis of the device. The outer conical portion is further comprised of a plurality of outer conical portion sections disposed to move perpendicular to the central axis when the inner conical portion moves distally relative to the outer conical portion.

In a seventh embodiment of the construction material repair device, the conical portion of the device further comprises an inner conical portion and an outer conical portion disposed to move relative to one another along the central axis of the device and where the outer conical portion further comprises a slot and where the inner conical portion is a conical plug, which when moved distal to the outer conical portion causes the outer conical portion to expand outward from the central axis.

In a first aspect of an eighth embodiment of the construction material repair device, similar to the first embodiment, the conical portion of the device is replaced by a series of cylindrical steps. Each of the cylindrical steps is smaller than the more proximal step and disposed such that each of the proximal and distal ends of each of the steps is perpendicular to the central axis of the device such that when inserting the device into the material to be repaired, the device will advance to the point where one of the steps is too large to fit into the hole in the material to be repaired and that step will but up against the outer surface of the material to be repaired.

In a second aspect of an eighth embodiment of the construction material repair device, similar to the first aspect of the eighth embodiment, each of the cylindrical steps is smaller than the more proximal step and disposed such that each of the proximal and distal ends of each of the steps disposed at an angle to the perpendicular of the central axis such that when inserting the device into the material to be repaired, the device will advance to the point where one of the steps is too large to fit into the hole in the material to be repaired and the distal most portion of that step will but up against the outer surface of the material to be repaired.

In a third aspect of an eighth embodiment of the construction material repair device, similar to the first embodiment, the conical portion of the device is replaced by a series of truncated conical steps. Each of the truncated conical steps has a proximal end that is smaller than the distal end of the more proximal step and disposed such that when inserting the device into the material to be repaired, the device will advance to the point where one of the steps is too large to fit into the hole in the material to be repaired and that step will but up against the outer surface of the material to be repaired.

In a fourth aspect of an eighth embodiment of the construction material repair device, similar to the third aspect of the eighth embodiment, the distal end of each of the truncated conical steps further comprises a raised edge.

In a first aspect of a ninth embodiment of the construction material repair device, similar to the first embodiment, the conical portion of the device is replaced by a series of truncated conical steps. Each of the truncated conical steps has a proximal end that is larger than the distal end of the more proximal step and which has a proximal surface perpendicular to the central axis of the device, thereby forming a barbed surface and disposed such that when inserting the device into the material to be repaired, the device with advance to the point where the proximal end of one of the steps is too large to fit through the hole in the material to be repaired and that step will form an interference fit with the material to be repaired.

In a second aspect of a ninth embodiment of the construction material repair device, similar to the first embodiment, the conical portion of the device is replaced by a series of truncated conical steps. Each of the truncated conical steps has a proximal end that is larger than the distal end of the more proximal step and which has a proximal surface disposed at an angle to the perpendicular of the central axis of the device, thereby forming a barbed surface and disposed such that when inserting the device into the material to be repaired, the device will advance to the point where the proximal end of one of the steps is too large to fit through the hole in the material to be repaired and that step will form an interference fit with the material to be repaired.

In a third aspect of a ninth embodiment of the construction material repair device, similar to the first embodiment, the conical portion of the device is replaced by a raised helical thread. The raised helical thread is disposed such that as the construction material repair device is placed in the hole in the construction material to be repaired, the device advances until a portion of the helical thread engages the exterior surface of the construction material to be repaired. At this point the user rotates the construction material repair device to engage the helical thread into an interference fit with the construction material to be repaired until the portion of the conical surface below the helical thread contacts the construction material to be repaired and prevents further advancement of the construction material repair device.

In a tenth embodiment of the construction material repair device, the device is comprised of a flat portion and a conical portion. The flat portion is disposed with a thickness that approximates a portion of a construction material to be repaired such as the paper covering of a drywall surface. The conical portion approximates a full right cone and further comprises a number of recesses disposed in the surface of the cone, where the axis of the recesses intersect the central axis of the right cone. The flat portion is also disposed such that its diameter is larger than the base of the right cone.

In a first embodiment of a construction material preparation device, the device comprises a conical cutting portion, a cylindrical cutting portion, a cylindrical stop portion and a stem portion. The conical cutting portion is disposed distal to the cylindrical cutting portion. The cylindrical cutting portion is disposed distal to the cylindrical stop portion. The cylindrical stop portion is disposed distal to the stem portion. The conical cutting portion and the cylindrical cutting portion include blades disposed to cut a material in contact with these portions. The cylindrical stop portion is disposed to contact the material in contact with the conical and cylindrical portions and to prevent the construction material preparation device from advancing more than a prescribed amount into the construction material to be repaired. The stem portion is disposed such that it may be inserted into a drill or other rotary tool and may include flats spaced around the periphery of the stem to increase the purchase of the stem portion in the drill or other rotary device.

In a first embodiment of a method of using the construction material repair device of any of the previously described embodiments a user identifies an existing defect, hole, crack or crevice or constructs a hole in the construction material that is to be repaired, the size of the defect, hole, crack or crevice being larger than the distal end of the construction material repair device and smaller than the proximal end of the construction material repair device. The user then removes any rough edges from the perimeter of the defect or may form a chamfer on one of or both of the surfaces of the construction material being repaired that faces the proximal or the distal end of the construction material repair device when the construction material repair device is installed. Next, the user applies a construction adhesive to the at least a portion of the conical surface and the recess of the construction material repair device and where the application of the construction adhesive extends to the portion of the construction material repair device which is larger than the hole in the construction material being repaired through to the portion of the construction material repair device which is smaller than the hole in the construction material being repaired. Next, the user applies construction adhesive to completely fill, the hole, defect, crack or crevice and then places the construction material repair device into the hole, defect, crack or crevice and rotates the construction material repair device in the hole, defect, crack or crevice until the construction material repair devices fully engages with the construction material to be repaired and stops. Next, the user may allow the construction adhesive to harden, dry or cure whereby it integrates into the construction material to be repaired and then the user uses a carpenter's saw or other suitable method known in the art to cut or grind the construction material repair device off flush with the exterior, interior or both surfaces of the construction material being repaired and removing the proximal, distal or both ends of the construction material repair device that is proximal to the cut.

In a second embodiment of a method of using the construction material repair device of the previous embodiment, the user identifies an existing hole, defect, crack or crevice or constructs a hole in the construction material that is to be repaired, the size of the hole being larger than the distal end of the remainder of the construction material repair device of the previous embodiment and smaller than the proximal end of the construction material repair device. The user then removes the rough edges of the hole, defect, crack or crevice and may form a chamfer on one of or both of the surfaces of the construction material being repaired that faces one or both of the proximal and the distal end of the construction material repair device when the construction material repair device is installed. Next, the user applies a construction adhesive to the at least a portion of the conical surface and the recess of the construction material repair device and where the application of the construction adhesive extends to the portion of the construction material repair device which is larger than the hole in the construction material being repaired through to the portion of the construction material repair device which is smaller than the hole in the construction material being repaired. Next, the user applies construction adhesive to completely fill, the hole, defect, crack or crevice and then places the construction material repair device into the hole, defect, crack or crevice and rotates the construction material repair device in the hole, defect, crack or crevice until the construction material repair devices fully engages with the construction material to be repaired and stops. Next, the user allows the construction adhesive to harden, dry or cure whereby it integrates with the construction material to be repaired and then the user uses a carpenter's saw or other suitable method known in the art to cut or grind the construction material repair device off flush with the exterior surface of the construction material being repaired.

The above-noted features and advantages of the present invention, as well as additional features and advantages, will be readily apparent to those skilled in the art upon reference to the following detailed description, accompanying drawings and appended claims, which include a disclosure of the best mode of making and using the invention presently contemplated.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

DETAILED DESCRIPTION

The present disclosure relates generally to a device for the repair of materials used in construction and more specifically relates to a device inserted into and used to repair a defect in a construction material.

It will be recognized that the scope of the present disclosure is not limited by specific applications, and that the apparatus and methods described herein may be employed in a variety of implementations. Further, while the ensuing disclosure includes illustrative embodiments employing devices and methods for the repair of construction materials, it will be appreciated that the disclosure contemplates the use of the device and methods on other materials where the use of the device provides a repair function.

Figure 1:
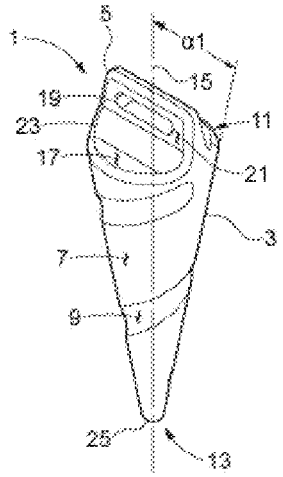
FIG. 1 is an isometric view of a construction material repair device, according to a first embodiment of the present disclosure with a first conical angle and a single helical recess.

Referring to FIG. 1, a construction material repair device 1 is shown. Construction material repair device 1 comprises a conical portion 3 and a tab 5. Conical portion 3 comprises a conical surface 7 including a conical surface area that forms a right circular cone with angle $\alpha 1$, a recess 9 formed in conical surface 7, including at least one recess area (the area of the conical portion 3 that is removed by the recess 9), a proximal end 11, a distal end 13 and a central axis 15. Central axis 15 is the axis about which conical portion 3 is revolved. As shown in FIG. 1, recess 9 comprises an arcuate cutout in conical surface 7 and extends clockwise helically (as seen from distal end 13) from a point near the distal end 13 to a point near the proximal end 11, thereby forming a right handed helical cut in the conical surface 7. Recess 9 is disposed such that rotation of the construction material repair device 1 causes recess 9 to engage with a material under repair and assists in the fixation of the construction material repair device 1 in a material under repair. Alternatively, there may be more than one recess 9 in the conical portion 3, each recess 9 spaced equally rotationally from the other recess 9. In a different embodiment (not shown) the intersection of recess 9 with conical surface 7 may also include a small, raised area (not shown). This small, raised area further increases the ability of construction material repair device 1 to engage with the construction material under repair. As shown in FIG. 1, recess 9 may be formed such that the depth of recess 9 in conical surface 7 remains the same along the entirety of the recess however recess 9 may vary in depth along the length of the recess. Also, the width of recess 9 may either remain the same along its length or may increase or decrease along its length. Distal end 13 of conical portion 3 may be formed at the end of conical portion 3 closest to the apex of the conical portion 3 and proximal end 11 of the conical portion 3 may be formed at the opposite end of the conical portion 3. As shown in FIG. 1, distal end 13 includes a spherical radius 25 with a point of tangency at the intersection between spherical radius 25 and conical surface 7. The proximal end 11 of conical portion 3 comprises a planar proximal surface 17 and the planar proximal surface 17 may be perpendicular to central axis 15. Tab 5 extends perpendicularly from planar proximal surface 17 and includes a cutout 19. Cutout 19 is shown as a slot cut perpendicularly through tab 5, however cutout 19 may also be a hole, a plurality of holes or a plurality of slots. Cutout 19 may also be designed to accept a screwdriver or other tool to allow for mechanical advantage in the rotation of construction material repair device 1. Cutout 19 may also be disposed such that it does not transect the entire thickness of tab 5. Instead, cutout 19 may extend from one wall 21 of tab 5 to a depth that is less than the full thickness of tab 5 or may extend from both walls 21 of tab 5 toward the midpoint of the thickness of tab 5 but not all the way to the midpoint of the thickness of tab 5. Cutout 19 may also comprise a series of cutouts spaced proximally to distally on tab 5. Walls 21 of tab 5 are shown in FIG. 1 to have a taper, with the base of tab 5 being larger than the top of tab 5, however the walls 21 of tab 5 may also project perpendicularly from planar proximal surface 17. Tab radius 23 is shown in FIG. 1 to join planar surface 17 and tab 5, however planar proximal surface 17 and tab 5 may join at a sharp edge. Additionally, on each side where tab 5 and planar proximal surface 17 come together, there may be a recess formed (not shown). The recess reduces the cross-sectional area of tab 5 at the point where tab 5 joins with planar proximal surface 17 so that tab 5 may be more easily broken off from planar proximal surface 17. In another embodiment, tab 5 comprises two or more tab portions (not shown), separated by a gap (not shown). Each of the tab portions is constructed in a manner similar to the single tab 5 described above with the exception that the gap is placed between the two tab portions, rendering each as an independent tab portion. The gap may be centered between the two tab portions or may be offset such that one tab portion is larger than the other tab portion. Additionally, the gap may extend down to the planar proximal surface 17 or may only extend a portion of the way to the planar proximal surface 17, leaving a rib (not shown) between the two tab portions. As shown in FIG. 1, construction material repair device 1 is formed such that the area of recess 9 is less than the area of conical surface 7, however the area of recess 9 can be equal to or greater than that of conical surface 7. Construction material repair device 1 may be made from one of a chalk, a wood, a fiberglass material, an elastomer, a drywall compound, a plastic material, a metal or any construction material known in the art. Construction material repair device 1 may also be made of a combination of the aforementioned materials. For instance, a central core (not shown) of construction material repair device 1 may be made of a first material and may substantially form a right cylinder or a right conical shape. A second material may then be placed over the first material, where the second material is joined to the first material either mechanically or with an adhesive and forms conical portion 3 and recess 9 of construction material repair device 1.

In an alternative embodiment, similar to that of FIG. 1, tab 5 is replaced by a slot or a plurality of slots (not shown) that extend a depth into conical portion 3 from proximal planar surface 17. The slots are sized to accept a flat bladed screwdriver, chisel or other flat tool that provides mechanical advantage in the rotation of construction material repair device 1. Where multiple slots are included, the slots are disposed such that they are spaced at equal angles and the slots meet at the central axis 15. For instance, two slots are placed at 90-degree angles from one another, and 3 slots are placed at 60-degree angles from one another. In a slightly different embodiment square hole (not shown) is placed in the proximal planar surface 17 of the construction material repair device 1 that extends into the conical portion 3. The square hole is disposed to accept a ratchet drive, allowing the connection of a ratchet device to rotate and advance the construction material repair device 1. In another slightly different embodiment a square or hexagonal boss (not shown) extends outward from proximal planar surface 17 and is disposed to accept a wrench or hex socket to allow the construction material repair device 1 to be rotated and advanced.

Figure 2:
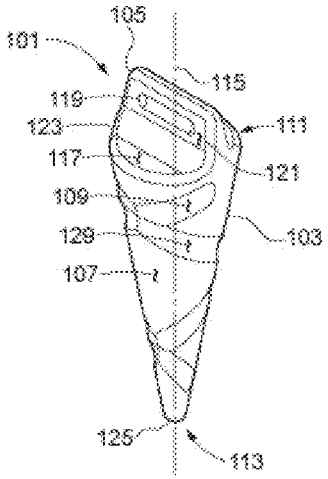
FIG. 2 is an isometric view of a construction material repair device, according to a second embodiment of the present disclosure with a first conical angle and two helical recesses.

Referring now to FIG. 2, where similar numbers are used to denote similar features in FIG. 1, a construction material repair device 101 is shown. In this embodiment construction material repair device 101 comprises a recess 109 like that shown in FIG. 1 and comprises a second recess 129 which includes a second recess area. Second recess 129 is the mirror image with respect to central axis 115 of recess 109 and extends counterclockwise helically (as viewed from distal end 113) from a point near distal end 113 to a point near proximal end 111. In this embodiment, the construction material repair device 101 may engage with a construction material under repair by rotating the construction material repair device 101 in either a clockwise or counterclockwise direction.

Figure 3:
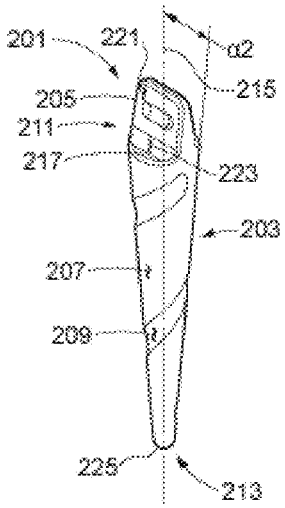
FIG. 3 is an isometric view of a construction material repair device, according to a third embodiment of the present disclosure with a second conical angle and a single helical recess.

Referring now to FIG. 3, where similar numbers are used to denote similar features in FIG. 1, a construction material repair device 201 is shown. In this embodiment construction material repair device 201 comprises features similar to construction material repair device 1 of FIG. 1, however the conical portion 203 is disposed at an angle $\alpha 2$. As shown, angle $\alpha 2$ is smaller than angle $\alpha 1$ of FIG. 1, however it may also be larger than angle $\alpha 1$ of FIG. 1. In this embodiment, tab 205 is completely solid and has no through slot or hole.

Figure 4:
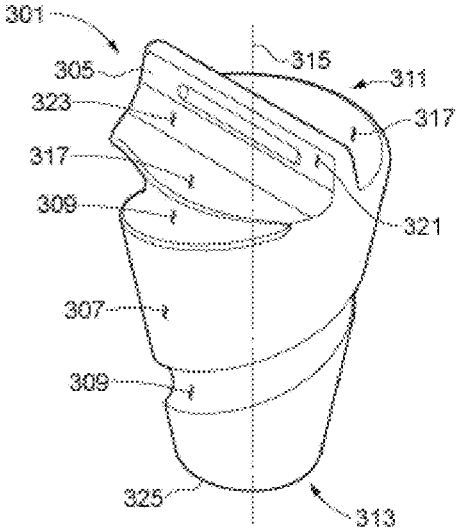
FIG. 4 is an isometric view of a construction material repair device, according to a fourth embodiment of the present disclosure with a single helical recess and a truncated distal end.

Referring now to FIG. 4, where similar numbers are used to denote similar features in FIG. 1, a construction material repair device 301 is shown. In this embodiment construction material repair device 301 comprises features similar to construction material repair device 1 of FIG. 1, however a distal end 313 comprises a planar distal surface 325. Planar distal surface 325 is substantially parallel to planar proximal surface 317. FIG. 4 also shows an alternative embodiment whereby recess 309 extends through proximal planar surface 317 and through distal planar surface 325.

Figure 5A:
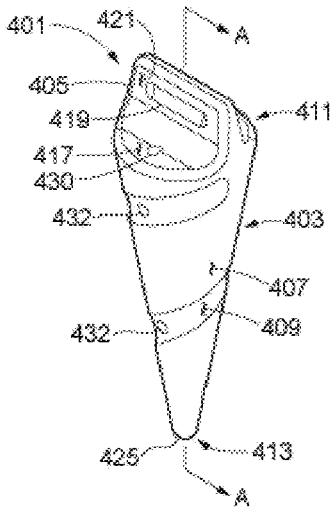
FIG. 5A is an isometric view of a construction material repair device, according to a fifth embodiment of the present disclosure with a first conical angle, a single helical recess and an adhesive channel.
Figure 5B:
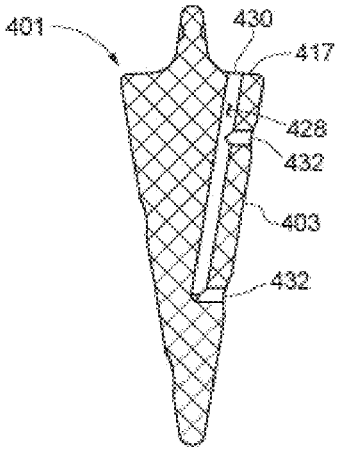
FIG. 5B is a cross sectional view of the construction material repair device of FIG. 5A, detailing one embodiment of an internal adhesive channel.

Referring now to FIG. 5A and FIG. 5B, where similar numbers are used to denote similar features in FIG. 1, a construction material repair device 401 is shown. In this embodiment construction material repair device 401 comprises features similar to construction material repair device 1 of FIG. 1, however conical portion 403 further comprises an adhesive input channel 428 that comprises an adhesive input hole 430 that runs through at least part of conical portion 403 from planar proximal surface 417 to at least a single adhesive outlet hole 432 in recess 409. Preferably, a plurality of branches (not shown) of adhesive input channel 428 lead to a plurality of adhesive outlet holes 432 in a plurality of locations of recess 409. The adhesive input channel 428 may be sized to fit the tip of a standard caulk style adhesive tube. In this way, the construction material repair device 401 may be placed in the construction material to be repaired 780 and then adhesive injected into adhesive input channel 428 to deliver adhesive to a plurality of areas of the construction material repair device 401. In an alternative embodiment, a plurality of adhesive input channels 428, each with a plurality of branches may be used.

Figure 6A:
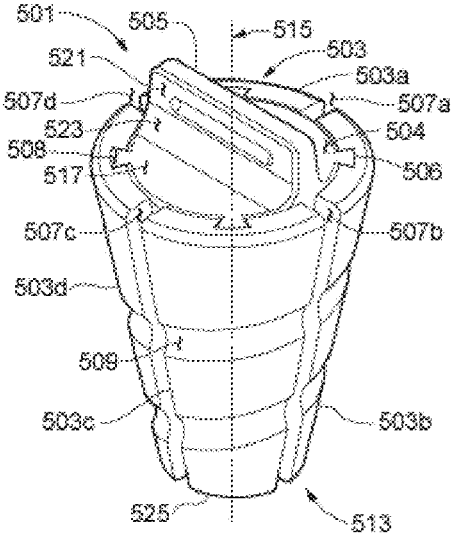
FIG. 6A is an isometric view of a construction material repair device, according to a sixth embodiment of the present disclosure with a central conical portion and four outer conical sections, with the central conical portion is in its most proximal position.
Figure 6B:
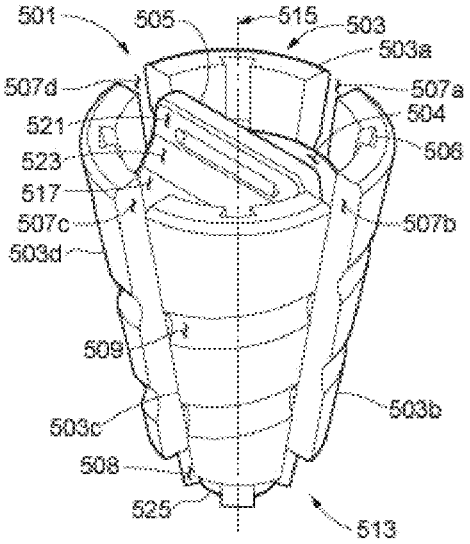
FIG. 6B is an isometric view of a construction material repair device, according to a sixth embodiment of the present disclosure with a central conical portion and four outer conical sections, with the central conical portion advanced distally from its most proximal position.

Referring now to FIG. 6A and FIG. 6B, where similar numbers are used to denote similar features in FIG. 1, a construction material repair device 501 is shown. In this embodiment construction material repair device 501 comprises features similar to construction material repair device 301 of FIG. 4, however conical portion 503 is split into four sections 503*a*, 503*b*, 503*c* and 503*d*. Four sections 503*a*-503*d* are each separated by four slots 507*a*-507*d*. In alternative embodiments as few as two sections or more than 4 sections may be employed. Construction material repair device 501 also comprises an inner conical portion 504, internal to conical portion 503. Conical portion sections 503*a*-503*d* also comprise a connection slot 506 and inner conical portion 504 also comprises a connection tab 508. Connection tab 508 fits within connection slot 506 such that inner conical portion 504 can move relative to sections 503*a*-503*d*. The outer surface of inner conical portion 504 is disposed at the same angle as the inner surface of conical portion sections 503*a*-503*d* such that as inner conical portion 504 is moved distal to conical portion 503, the four sections 503*a*-503*d* move outward. In this way, when construction material repair device 501 is placed into construction material to be repaired 780 (see FIG. 10D) and inner conical portion 504 is moved distally with respect to conical portion 503, sections 503*a*-503*d* move outward to better engage construction material repair device 501 with construction material to be repaired 780. While connection tab 508 and connection slot 506 are shown as a dovetail construction, other constructions such as T-slots, L-slots or other connection slots known in the art may be used.

In another embodiment of the construction material repair device 501 of FIG. 6A and FIG. 6B, the vertical tabs and slots are replaced by helical screw threads (not shown) and screw slots (not shown) on inner conical portion 504 and four sections 503*a*-503*d* respectively such that rotation of inner conical portion 504 causes inner conical portion 504 to move distally with respect to four sections 503*a*-503*d* and to move four sections 503*a*-503*d* outward.

Figure 7:
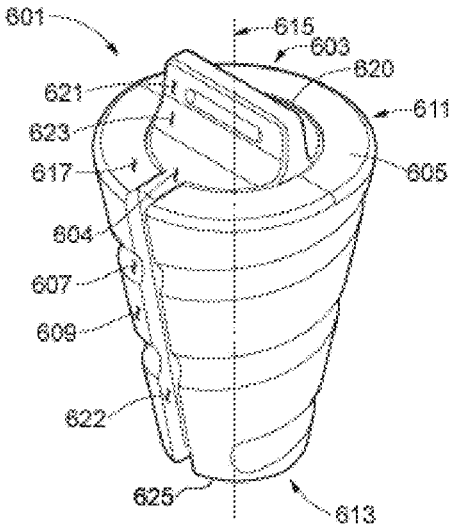
FIG. 7 is an isometric view of a construction material repair device, according to a seventh embodiment of the present disclosure, with a central hole and a slot in the side of the conical portion.

Referring now to FIG. 7, where similar numbers are used to denote similar features in FIG. 1, construction material repair device 601 may include a central hole 620 and a slot 622 in conical portion 603. In this embodiment to fix construction material repair device 601 into construction material to be repaired 780 (see FIG. 10D), the user drives a tapered dowel 604 into hole 620, causing conical portion 603 to expand.

Figure 8A:
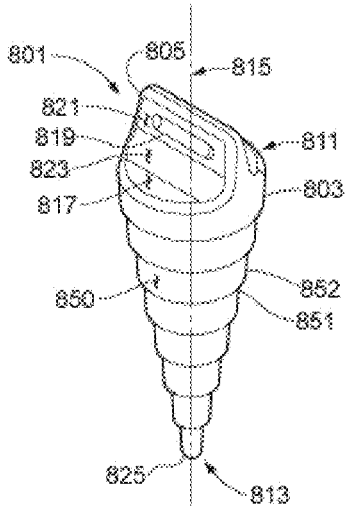
FIG. 8A is an isometric view of a construction material repair device, according to a first aspect of an eighth embodiment of the present disclosure similar to the first embodiment of FIG. 1 but with a plurality of cylindrical steps perpendicular to the conical axis replacing the conical portion of the first embodiment.

Referring now to FIG. 8A, where similar numbers are used to denote similar features in FIG. 1, a first aspect of a seventh embodiment of the construction material repair device 801 is shown. In this embodiment, the conical portion 803 of construction material repair device 801 is comprised of a series of right cylinders 850, wherein the proximal cylinder end 851 of one right cylinder 850 abuts the distal cylinder end 852 of the next right cylinder 850. Moving from the proximal end 811 to the distal end 813 of construction material repair device 801, each right cylinder 850 is of a smaller diameter than the previous right cylinder 850. The surface of proximal cylinder end 851 and distal cylinder end 852 are disposed such that they are perpendicular to central axis 815.

Figure 8B:
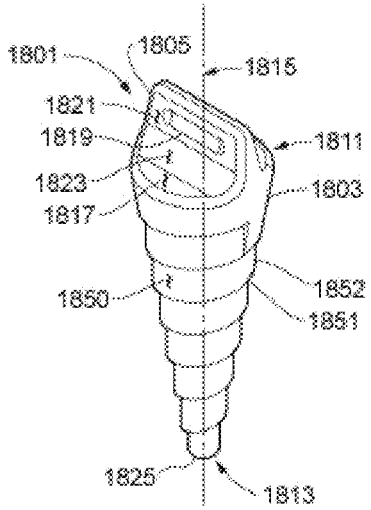
FIG. 8B is an isometric view of a construction material repair device, according to a second aspect of an eighth embodiment of the present disclosure similar to the first aspect of the eighth embodiment of FIG. 8A but with the plurality of cylindrical steps placed at an angle to the conical axis.

Referring now to FIG. 8B, where similar numbers are used to denote similar features in FIG. 8A, a second aspect of a seventh embodiment of the construction material repair device 1801 is shown. In this embodiment, the conical portion 1803 of construction material repair device 1801 is comprised of a series of cylinders 1850, wherein the proximal cylinder end 1851 of one cylinder 1850 abuts the distal cylinder end 1852 of the next cylinder 1850. Moving from the proximal end 1811 to the distal end 1813 of construction material repair device 1801, each cylinder 1850 is of a smaller diameter than the previous cylinder 1850. The surface of proximal cylinder end 1851 and distal cylinder end 1852 are disposed such that they form an angle with respect to central axis 1815.

Figure 8C:
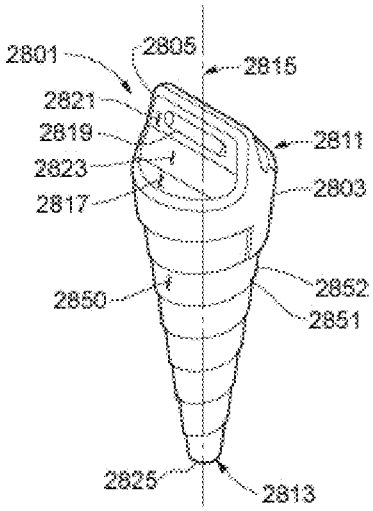
FIG. 8C is an isometric view of a third aspect of an eighth embodiment of a construction material repair device, similar to the first aspect of the eighth embodiment of FIG. 8A but with each of the plurality of cylindrical steps replaced with a truncated conical step at an angle to the conical axis.

Referring now to FIG. 8C, where similar numbers are used to denote similar features in FIG. 8A, a third aspect of a seventh embodiment of the construction material repair device 2801 is shown. In this embodiment, the conical portion 2803 of construction material repair device 2801 is comprised of a series of conical sections 2850, wherein the proximal conical section end 2851 of one conical section 2850 abuts the distal conical section end 2852 of the next conical section 2850. Moving from the proximal end 2811 to the distal end 2813 of construction material repair device 2801, each conical section 2850 is of a smaller average diameter than the previous conical section 2850. The surface of proximal conical section end 2851 and distal conical section end 2852 are disposed such that they form an angle with respect to central axis 2815, however it is also contemplated that they may be perpendicular to central axis 2815.

Figure 8D:
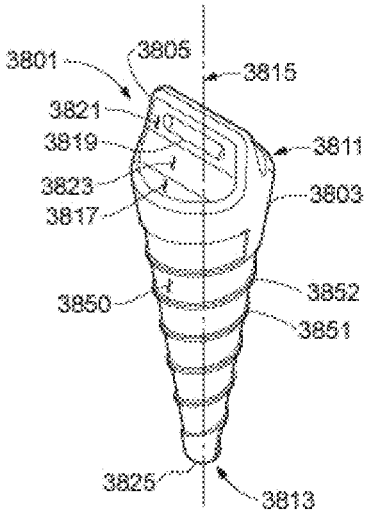
FIG. 8D is an isometric view of a fourth aspect of an eighth embodiment of the construction material repair device, similar to the third aspect of the eighth embodiment of FIG. 8C but with a raised edge at the distal potion of each of the truncated conical steps.

Referring now to FIG. 8D, where similar numbers are used to denote similar features in FIG. 8A, a fourth aspect of a seventh embodiment of the construction material repair device 3801 is shown. In this embodiment, the conical portion 3803 of construction material repair device 3801 is comprised of a series of conical sections 3850, wherein the proximal conical section end 3851 of one conical section 3850 abuts the distal conical section end 3852 of the next conical section 3850 and distal conical section end 3852 may be further comprised of a raised portion to provide better purchase of the construction material repair device 3801 into the material to be repaired. Moving from the proximal end 3811 to the distal end 3813 of construction material repair device 3801, each conical section 3850 is of a smaller average diameter than the previous conical section 3850. The surface of proximal conical section end 3851 and distal conical section end 3852 are disposed such that they form an angle with respect to central axis 3815, however it is also contemplated that they may be perpendicular to central axis 3815.

Figure 9A:
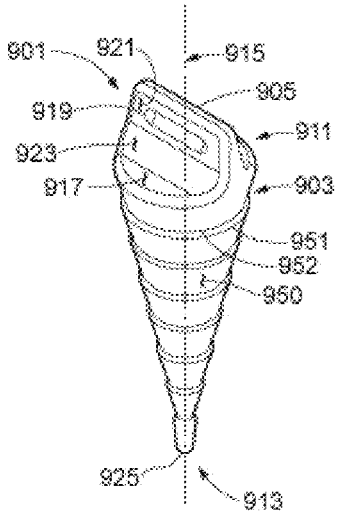
FIG. 9A is an isometric view of a construction material repair device, according to a first aspect of a ninth embodiment of the present disclosure similar to the first embodiment of FIG. 1 but with a plurality of conical steps perpendicular to the conical axis replacing the conical portion of the first embodiment, forming a plurality of barbs.

Referring now to FIG. 9A, where similar numbers are used to denote similar features in FIG. 1, a first aspect of an eighth embodiment of the construction material repair device 901 is shown. In this embodiment, the conical portion 903 of construction material repair device 901 is comprised of a series of right conical sections 950, wherein the proximal conical section end 951 of one right conical section 950 abuts the distal conical section end 952 of the next right conical section 950. Where each successive set of proximal conical sections 951 and distal conical section ends 952 meet, the diameter of the proximal conical section end 951 is smaller than the distal conical section end 952. Moving from the proximal end 911 to the distal end 913 of construction material repair device 901, each distal conical section end 952 has a larger diameter than the next distal conical section end 952 such that the overall form produces a conical portion 903. The surface of proximal conical section end 951 and distal conical section end 952 are disposed such that they are perpendicular to central axis 915.

Figure 9B:
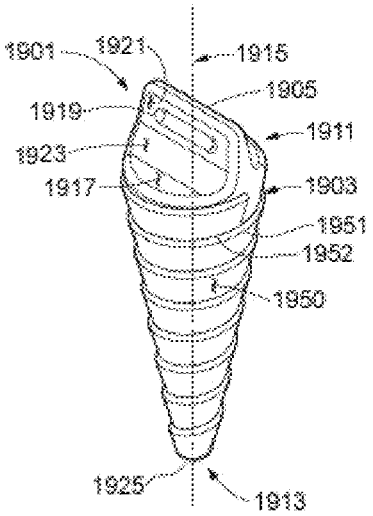
FIG. 9B is an isometric view of a construction material repair device, according to a second aspect of the ninth embodiment of the present disclosure similar to the first aspect of the ninth embodiment of FIG. 9A but with the plurality of conical steps formed at an angle to the perpendicular of the conical axis.

Referring now to FIG. 9B, where similar numbers are used to denote similar features in FIG. 1, a second aspect of an eighth embodiment of the construction material repair device 1901 is shown. In this embodiment, the conical portion 1903 of construction material repair device 1901 is comprised of a series of right conical sections 1950, wherein the proximal conical section end 1951 of one right conical section 1950 abuts the distal conical section end 1952 of the next right conical section 1950. Where each successive set of proximal conical sections 1951 and distal conical section ends 1952 meet, the diameter of the proximal conical section end 1951 is smaller than the distal conical section end 1952. Moving from the proximal end 1911 to the distal end 1913 of construction material repair device 1901, each distal conical section end 1952 has a larger diameter than the next distal conical section end 1952 such that the overall form produces a conical portion 1903. The surface of proximal conical section end 1951 and distal conical section end 1952 are disposed such that they form an angle to central axis 1915.

Figure 9C:
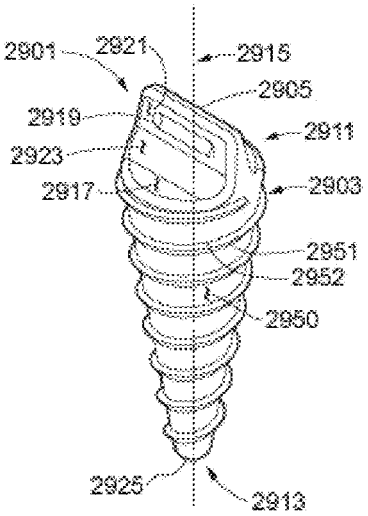
FIG. 9C is an isometric view of a construction material repair device, according to a third aspect of a ninth embodiment of the present disclosure similar to the first embodiment of FIG. 1 but with a helical raised edge extending from the distal portion of the device to the proximal portion of the device on the conical surface.

Referring now to FIG. 9C, where similar numbers are used to denote similar features in FIG. 1, a third aspect of an eighth embodiment of the construction material repair device 2901 is shown. In this embodiment, the conical portion 2903 of construction material repair device 2901 is comprised of a series of right conical sections 2950, wherein the proximal conical section end 2951 of one right conical section 2950 abuts the distal conical section end 2952 of the next right conical section 2950. Proximal conical section end 2951 also includes a raised portion to increase the purchase of construction material repair device 2901 in a material to be repaired. Where each successive set of proximal conical sections 2951 and distal conical section ends 2952 meet, the diameter of the proximal conical section end 2951 is smaller than the distal conical section end 2952. Moving from the proximal end 2911 to the distal end 2913 of construction material repair device 2901, each distal conical section end 2952 has a larger diameter than the next distal conical section end 2952 such that the overall form produces a conical portion 2903. The surface of proximal conical section end 2951 and distal conical section end 2952 are disposed such that they are perpendicular to central axis 2915.

Figure 10A:
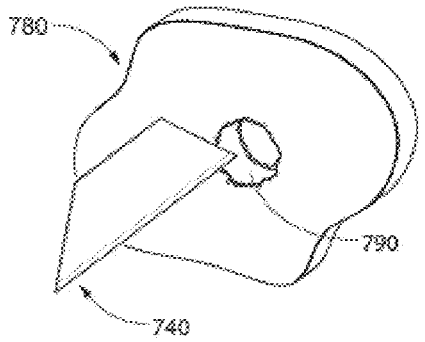
FIG. 10A is a perspective view of construction material with a single through-hole defect and a utility blade angled into the through-hole to cut out the rough edge of the defect, according to a method of using any of the embodiments of the present disclosure.
Figure 10B:
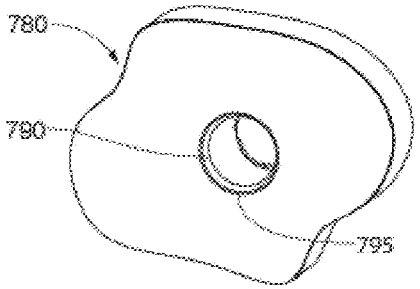
FIG. 10B is a perspective view of construction material with a single through-hole defect with the rough edge of the defect removed by the utility blade in the form of a chamfered edge, according to a method of using any of the embodiments of the present disclosure.
Figure 10C:
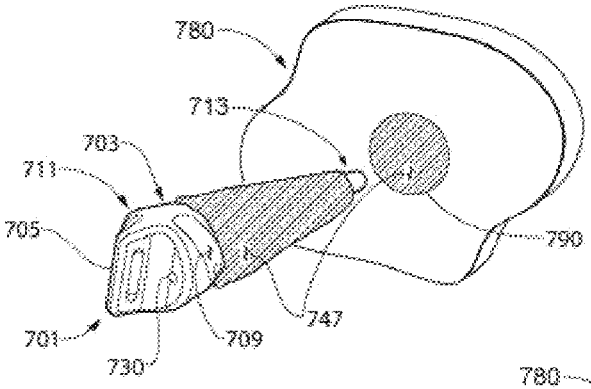
FIG. 10C is a perspective view of construction material with a single through-hole defect filled with adhesive material and a construction material repair device covered with adhesive material, aligned to insert into the defect, according to a method to use the first embodiment of the present disclosure.
Figure 10D:
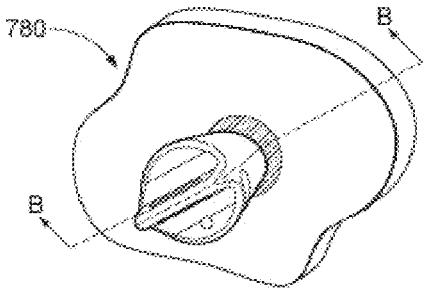
FIG. 10D is a perspective view of construction material with a single through-hole defect filled with adhesive material and a construction material repair device covered with adhesive material, inserted into the defect, according to a method to use the first embodiment of the present disclosure.
Figure 10E:
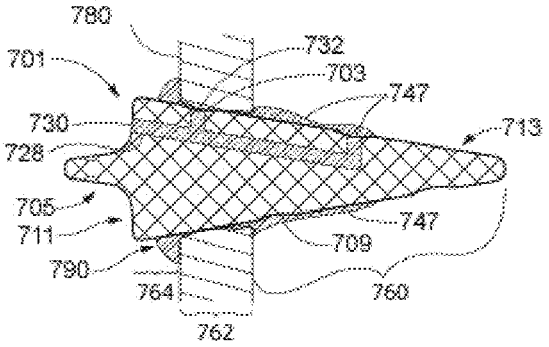
FIG. 10E is a side section view through section B-B of construction material with a single through-hole defect filled with adhesive material and, a construction material repair device covered with adhesive material, inserted until it stops to create an interference fit into the defect, according to a method to use the fifth embodiment of the present disclosure.
Figure 11A:
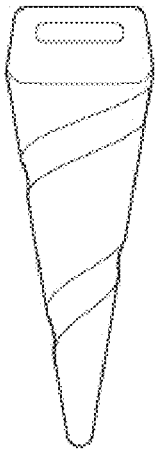
FIG. 11A is a front view of the construction material repair device of FIG. 1.
Figure 11B:
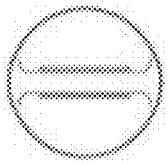
FIG. 11B is a top view of the construction material repair device of FIG. 1.
Figure 11C:
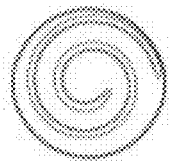
FIG. 11C is a bottom view of the construction material repair device of FIG. 1.
Figure 11D:
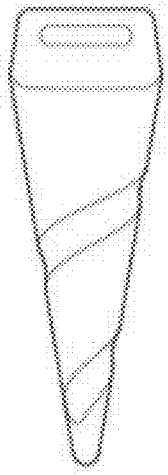
FIG. 11D is a back view of the construction material repair device of FIG. 1.
Figure 11E:
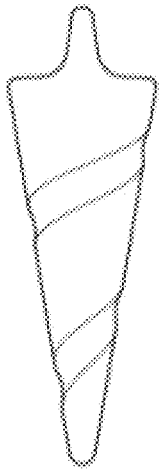
FIG. 11E is a left side view of the construction material repair device of FIG. 1.
Figure 11F:
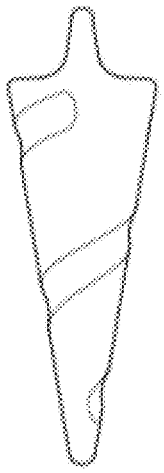
FIG. 11F is a right side view of the construction material repair device of FIG. 1.
Figure 11G:
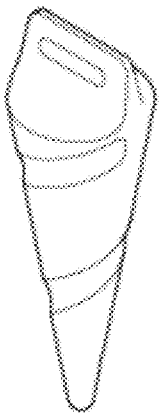
FIG. 11G is an isometric view of the construction material repair device of FIG. 1.
Figure 12A:
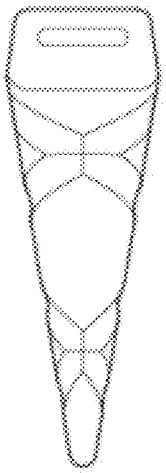
FIG. 12A is a front view of the construction material repair device of FIG. 2.
Figure 12B:
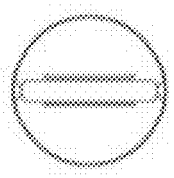
FIG. 12B is a top view of the construction material repair device of FIG. 2.
Figure 12C:
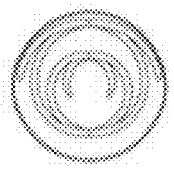
FIG. 12C is a bottom view of the construction material repair device of FIG. 2.
Figure 12D:
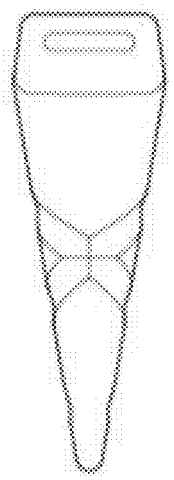
FIG. 12D is a back view of the construction material repair device of FIG. 2.
Figure 12E:
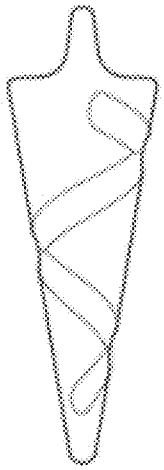
FIG. 12E is a left side view of the construction material repair device of FIG. 2.
Figure 12F:
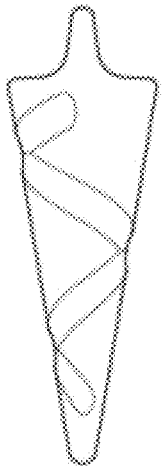
FIG. 12F is a right side view of the construction material repair device of FIG. 2.
Figure 12G:
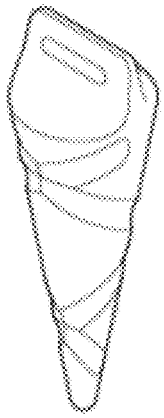
FIG. 12G is an isometric view of the construction material repair device of FIG. 2.
Figure 13A:
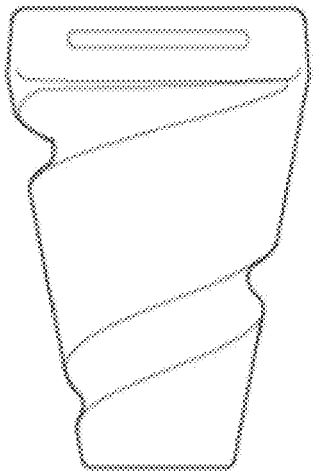
FIG. 13A is a front view of the construction material repair device of FIG. 4.
Figure 13B:
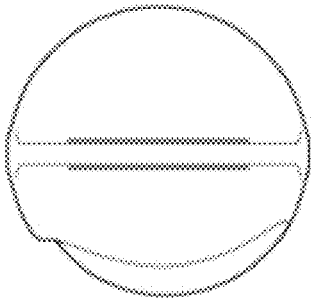
FIG. 13B is a top view of the construction material repair device of FIG. 4.
Figure 13C:
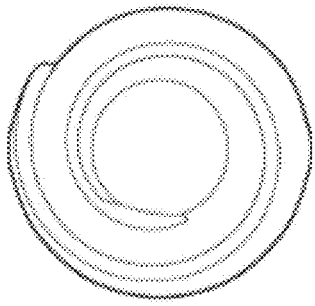
FIG. 13C is a bottom view of the construction material repair device of FIG. 4.
Figure 13D:
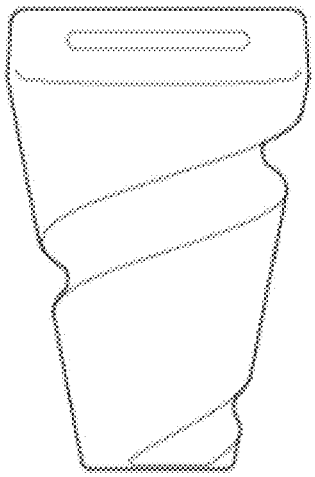
FIG. 13D is a back view of the construction material repair device of FIG. 4.
Figure 13E:
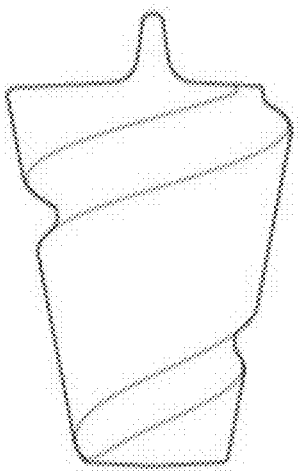
FIG. 13E is a left side view of the construction material repair device of FIG. 4.
Figure 13F:
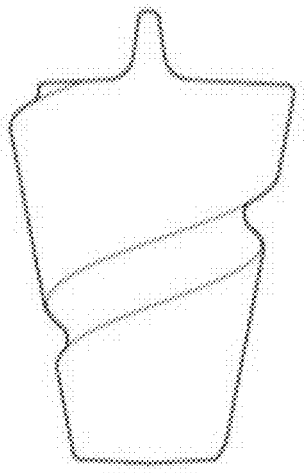
FIG. 13F is a right side view of the construction material repair device of FIG. 4.
Figure 13G:
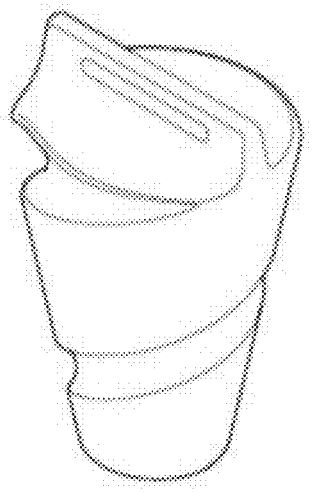
FIG. 13G is an isometric view of the construction material repair device of FIG. 4.

Referring now to FIG. 10A-10E, where similar features are referred to by similar numbers, a method of using the construction material repair device 701 of the current invention is shown. FIG. 10A shows a partial view of a construction material to be repaired 780, including a hole 790 and a cutting device 740. Cutting device 740 may be a carpenter's knife, a utility blade, a saw, a drill, a countersink bit or any other construction cutting device or combination of cutting devices known in the art. The user identifies an existing hole, defect, crack or crevice in the construction material to be repaired 780 or cuts the construction material to be repaired 780 with the cutting device 740 to remove rough edges and/or create hole 790 such that hole 790 has a diameter greater than distal end 713 of construction material repair device 701 and smaller than proximal end 711 of construction material repair device 701. The user also uses cutting device 740 to create a chamfer 795 like that shown in FIG. 10B. Next, as shown in FIG. 10C, the user takes construction material repair device 701 and applies a coating of construction adhesive 747 to conical portion 703 of construction material repair device 701. Construction adhesive 747 may be one of a drywall compound, structural polyurethane adhesive, epoxy adhesive, glue, a silicone adhesive or any adhesive known in the art. Next, construction adhesive 747 is applied to a portion of construction material repair device 701 such that when construction material repair device 701 is placed in hole 790, construction adhesive 747 extends beyond both exterior surfaces of construction material to be repaired 780. Additionally, construction adhesive 747 is applied into hole 790. Next, as shown in FIG. 10D, construction material repair device 701 is placed into hole 790 and seated into place. Construction material repair device 701 may be seated by pushing construction material repair device 701 into hole 790 until it stops. Construction material repair device 701 may also be seated by hammering on tab 705 to drive it into hole 790 or it may be seated by rotating it in hole 790 until recess 709 engages with construction material to be repaired 780, or some combination of these methods. As shown in FIG. 10E, the combination of recess 709 in construction material repair device 701, construction adhesive 747 and construction material to be repaired 780, when construction adhesive 747 dries or cures is sufficient to hold construction material repair device 701 securely in construction material to be repaired 780.

Referring to FIG. 10E, construction material repair device 701, when assembled, comprises three separate zones, first zone 760, second zone 762 and third zone 764. First zone 760 is the portion of the assembled device closest to distal end 713 that is outside construction material to be repaired 780. Second zone 762 is the portion of the assembled device internal to construction material to be repaired 780. Third zone 764 is the portion of the assembled device closest to proximal end 711 that is outside construction material to be repaired 780.

When construction adhesive 747 dries or cures and construction material repair device 701 is securely attached to construction material to be repaired 780, the user next cuts or grinds construction material repair device 701 off flush with the surface of construction material to be repaired 780 using a carpenter's saw, grinder or other construction material cutting device known in the art and sands it flush to that surface. In an alternative embodiment, construction material repair device 701 is cut off flush with the construction material to be repaired prior to construction adhesive 747 drying or curing.

In an alternative embodiment, construction material repair device 701 is rotated to engage with construction material to be repaired 780 such that proximal end 711 sits below the outer surface of construction material to be repaired 780. The user then removes tab 705 and fills the portion of the assembly that's sits below the outer surface of construction material to be repaired 780 with a drywall compound or other construction material suitable to be sanded flush to the exterior surface of construction material to be repaired 780.

In another alternative embodiment, construction material repair device 701 is placed into hole 790 in construction material to be repaired 780. The user then uses a pencil or other marking apparatus (not shown) to mark on construction material repair device 701 where it intersects with construction material to be repaired 780 or along a line slightly proximal to the intersection. The user next removes construction material repair device 701 from hole 790 and cuts it off along the marked intersection line (not shown). The user next applies construction adhesive 747 to construction material repair device 701 and places construction material repair device 701 into hole 790. Next, construction adhesive 747 is allowed to dry or cure and then sanded flush to the outer surface of construction material to be repaired.

In another alternative embodiment, construction material repair device 701 of FIG. 10A-10E uses the device described above and shown in FIG. 5A and FIG. 5B. In this embodiment, no construction adhesive 747 is applied to conical portion 703 prior to placing construction material repair device 701 in hole 790. Instead, construction material repair device 701 is placed in hole 790 and then rotated or hammered in to engage with the construction material to be repaired 780. Next, the user places the tip of a construction adhesive caulking type tube (not shown) into adhesive input hole 430 (See FIG. 5A) and actuates the trigger of the caulking type device (not shown), causing adhesive material 747 to flow through adhesive input channel 428 (See FIG. 5B) and out though the openings in recess 409.

In yet another alternative embodiment, construction material repair device 701 of FIG. 10A-10E is used to repair a first defect or hole 790 in construction material to be repaired 780. After construction material repair device 701 is cut off flush with the exterior surface of construction material to be repaired 780, the proximal portion of the construction material repair device 701 is saved for additional use. Next, the user either identifies or makes another hole 790 in the original construction material to be repaired 780 or makes a hole in a new construction material to be repaired 780. In this case, hole 790 in construction material to be repaired 780 is larger than distal end 713 of the remaining portion of construction material repair device 701 but smaller than proximal end 711 of construction material repair device 701. The application of construction adhesive 747, seating of the device and flush cutoff are the same as in the other embodiments described above. This process may be repeated as many times as a sufficient amount of the original construction material repair device 701 remains after the flush cutoff to affect additional repairs. Additionally if the distal section of the construction material repair device 701 is removed, this portion may also be used to effect additional repairs as well and this process may be repeated as long as a sufficient amount of the distal end 713 of the construction material repair device 701 remains to effect repairs. The tab 705, once removed from the remainder of construction material repair device 701 may also be used to effect repairs to a construction material to be repaired 708. In this case the more oblong shape of the t ab 705 may be placed in more linear defects such as cracks or the linear seams between adjoining sheets of drywall.

In yet one more alternative embodiment, the construction material repair device may be used to create a more structurally sound area for placement of a drywall anchor. In this embodiment a hole 790 is drilled in a non-disturbed surface of a construction material to be repaired 780 and the construction material repair device 701 is applied, adhered and prepped in the manners described above. At this point the user drills a hole (not shown) in the construction material repair device 701 and places a drywall anchor (not shown) into the hole. In this way the drywall anchor may be placed in a more robust material than the construction material to be repaired 780 or the load bearing area in the construction material to be repaired 780 may be increased by the addition of the construction material repair device 701.

Figure 14:
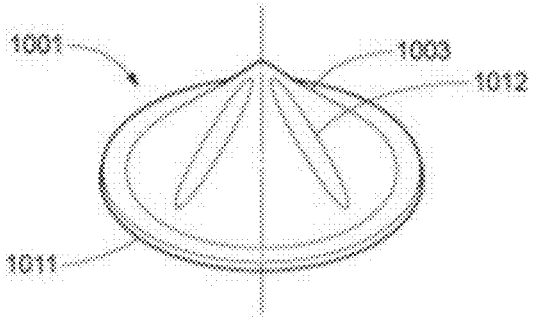
FIG. 14 is an isometric view of a tenth embodiment of a construction material repair device, including a conical portion and a flat portion, where the flat portion is disposed to match the surface layer of the construction material to be repaired.
Figure 15:
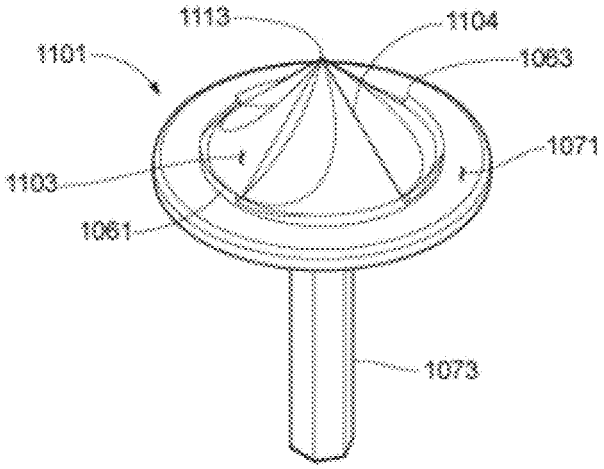
FIG. 15 is an isometric view of a tool for preparing a construction material to accept the construction material repair device shown in FIG. 14.

Referring now to FIG. 14 and FIG. 15, another embodiment of a construction material repair device 1001 and a preparation tool bit 1101 for preparing a construction material to be repaired are shown. The construction material repair device 1001 shown in FIG. 14 comprises a conical portion 1003 and a planar proximal portion 1011. In the embodiment shown, the conical portion 1003 may be made of a first material and the planar proximal portion 1011 may be made of a second material. In some embodiments, both the conical portion 1003 and the planar proximal portion 1011 are made of the same material. Conical portion 1003 may be made of a chalk, a wood, a fiberglass material, an elastomer, a drywall compound, a plastic material, a metal or any construction material known in the art, while proximal planar portion 1011 may be made of these materials or from a drywall paper, a wood veneer, a plastic, a metal or any construction material known in the art. In an alternative embodiment, conical portion 1003 and proximal planar portion 1011 are two separate pieces that are joined during the repair process with an adhesive. Conical portion 1003 may also include linear recesses 1012. Linear recesses 1012 begin at a point distal to planar proximal portion 1011 and end at a point proximal to the apex of conical portion 1003 and are recessed a depth into conical portion 1003. As shown in FIG. 14, linear recesses 1012 taper at their ends until they are flush with the surface of conical portion 1003. In a different embodiment, linear recesses 1012 extend from proximal planar portion 1011 to the apex of conical portion 1003 and do not taper at their ends. Linear recesses 1012 may have an arcuate cross section, a rectangular cross section, a triangular cross section or other geometric cross section known in the art.

Preparation tool bit 1011 is shown in FIG. 15 and comprises a core conical portion 1103, a core cylindrical portion 1061, a stop portion 1071, a stem portion 1073, a conical cutting portion 1104 and a cylindrical cutting portion 1063. Core conical portion 1103 is a right conical shape and the distal end 1113 of conical portion 1103 comes to a substantially sharp point. Stem portion 1073 of preparation tool bit 1101 is placed into a rotary cutting tool (not shown) such as a drill stand, a hand drill (powered or manual) or other rotary cutting tool known in the art and locked into place. The user next places the distal end 1113 of preparation tool bit 1101 against a material to be repaired, activates the rotary cutting tool and cuts into the material to be repaired until the stop portion 1071 comes into contact with the material to be repaired. In this way, the material to be repaired is prepared to accept construction material repair device 1001.

Once the material to be repaired is prepared, the user applies a construction adhesive such as one of those previously discussed to the conical portion 1003 and the planar proximal portion 1011 of the construction material repair device 1001 of FIG. 14. The user then places the construction material repair device 1001 into the area prepared with the preparation tool bit 1101 such that the distal surface of 1011 is flush with the construction material to be repaired 780. The user then removed any excess adhesive with a putty knife or other suitable tool and allows the construction adhesive to dry, harden or cure and then sands the surface of the construction material repair device 1001 flush with the material to be repaired. In most instances, no sanding is required. In cases where the conical portion 1003 and the planar proximal portion 1011 of the construction material repair device 1001 are separate entities, the user adheres the planar proximal portion 1011 to the conical portion 1003 and the material to be repaired using the adhesive pre-applied to the proximal planar portion 1011 and then presses the construction material repair device 1001 into the area prepared by the preparation tool 1101 such that the distal surface of proximal planar portion 1011 is flush with the surface of construction material to be repaired 780. The user then removes any excess construction adhesive with a putty knife or other suitable tool and sands the proximal planar portion 1011 off flush with the material to be repaired 780. In most instances no sanding is required.

While the disclosure has been described herein in reference to specific aspects, features and illustrative embodiments, it will be appreciated that the utility of the disclosure is not limited, but rather extends to and encompasses numerous other variations, modifications and alternative embodiments, as will suggest themselves to those of ordinary skill in the field of the present disclosure, based on the description. Correspondingly, the invention as claimed is intended to be broadly construed and interpreted, as including all such variations, modifications and alternative embodiments, within its spirit and scope.

I claim:

1. A construction material repair device for repairing a construction material, comprising;

a conical portion, further comprising;

a conical surface including a conical surface area, whereby said conical surface forms a right circular cone;

a central axis, whereby said central axis is coincident with a rotational axis of said right circular cone;

a recess formed in said conical surface including a recess area;

whereby said recess forms a helical cut in said conical surface;

whereby said recess area is defined as the area of said conical surface area removed by said recess; and a recess edge formed by an intersection of said conical surface and said recess;

a distal end, whereby said distal end is located in close proximity to an apex of said conical surface;

a proximal end, opposite said distal end; and a proximal planar surface at said proximal end of said conical portion;

whereby said recess area is less than an area of said conical surface area outside of said recess area.

2. The construction material repair device of claim 1, further comprising a distal end feature whereby said distal end feature is one of a spherical radius tangent to said conical surface of said conical portion or a flat distal surface formed by transecting said distal end of said conical portion at a distance to and parallel to said proximal planar surface.

3. The construction material repair device of claim 2, whereby said distance between said proximal planar surface and said distal end feature defines a device length and whereby said device length is greater than a material thickness of a material to be repaired.

4. The construction material repair device of claim 3, whereby said construction material repair device is formed from a material selected from one of a chalk, a wood, a fiberglass material, a drywall compound, a metal or a plastic.

5. The construction material repair device of claim 4, whereby said construction material repair device is disposed to accept a construction adhesive on said conical portion and said proximal planar surface.

6. The construction material repair device of claim 5, whereby said construction adhesive is selected from one of a drywall compound, a structural polyurethane adhesive, an epoxy adhesive, a glue, or a silicone adhesive.

7. The construction material repair device of claim 6, further comprising a tab extending perpendicular to said proximal planar surface, said tab further comprising;

a plurality of side walls, whereby said side walls are disposed at an angle to the perpendicular of said proximal planar surface and whereby a base of said tab has thickness greater than a top of said tab; and a cutout extending from one of said plurality of side walls to another of said plurality of sidewalls, whereby said cutout is perpendicular to said central axis of said right circular cone.

8. The construction material repair device of claim 7 whereby said recess edge is radiused.

9. The construction material repair device of claim 8, whereby said recess extends through said proximal planar surface.

10. The construction material repair device of claim 9, whereby said distal end of said construction material repair device has a smaller diameter than a hole in said material to be repaired and whereby said proximal end of said construction material repair device has a larger diameter than said hole in said material to be repaired.

11. The construction material repair device of claim 10, whereby said construction material repair device is disposed to form an interference fit with said material to be repaired when said construction material repair device is advanced into said hole in said material to be repaired.

12. The construction material repair device of claim 11, whereby said construction material repair device further comprises at least three zones, whereby a first zone of said at least three zones is the portion of said construction material repair device proximal to said proximal side of said material to be repaired.

13. The construction material repair device of claim 12, whereby a second zone of said at least three zones is the portion of said construction material repair device is the portion of said construction material repair device that is distal to a distal side of said material to be repaired, whereby said distal side is the side of said material to be repaired opposite said proximal side.

14. The construction material repair device of claim 13, whereby a third zone of said at least three zones is the portion of said construction material repair device that is between said zone one and said zone two.

15. The construction material repair device of claim 14, whereby placement of said construction material repair device in said hole in said material to be repaired causes said construction adhesive on said distal side of material to be repaired to extend beyond said hole and onto said distal side of said material to be repaired and causes said construction adhesive on said proximal side of said material to be repaired to extend beyond said hole and onto said proximal side of said material to be repaired.

16. A construction material repair device for repairing a construction material, comprising;

a conical portion further comprising;

a conical surface including a conical surface area, whereby said conical surface forms a right circular cone;

at least one recess formed in the conical surface including a recess area;

whereby said recess area is defined as the area of said conical surface area removed by said at least one recess;

a distal end, whereby said distal end is located in close proximity to an apex of said conical surface;

a proximal end, opposite said distal end;

a recess edge formed by an intersection of said conical surface and said at least one recess;

a proximal planar surface at said proximal end;

an end feature at said distal end;

a central axis, whereby said central axis coincident with a rotational axis of said right circular cone; and a tab, extending perpendicularly from said proximal planar surface; comprising a plurality of tab walls, the distance between said tab walls defining a tab thickness;

a cutout, whereby said cutout extents through at least a portion of said tab thickness in a direction perpendicular to said central axis;

whereby said recess area is less than an area of said conical surface area outside of said recess area; and whereby said at least one recess forms one of a right handed tapered helical cut, a left handed tapered helical cut, or a combination of right handed and left handed tapered helical cuts in said conical surface.

17. The construction material repair device of claim 16, whereby said cutout in said tab comprises one of a hole, a plurality of holes, an elongated slot, a plurality of elongated slots or a combination of holes and slots.

18. The construction material repair device of claim 17, whereby said construction material repair device is formed from a material selected from one of a chalk, a wood, a fiberglass material, a drywall compound, a metal or a plastic.

19. The construction material repair device of claim 18, whereby said construction material repair device is disposed to accept a construction adhesive on said conical portion, said proximal planar surface and said tab.

20. The construction material repair device of claim 19, whereby a cross-sectional area of said at least one recess is disposed to allow the flow of a construction adhesive within said at least one recess and whereby said construction adhesive is selected from one of a drywall compound, a structural polyurethane adhesive, an epoxy adhesive, a glue or a silicone adhesive.

* * * * *